United States Patent [19]

Babb et al.

[11] Patent Number: 5,031,276

[45] Date of Patent: Jul. 16, 1991

[54] DRAIN CLEANING MACHINE

[75] Inventors: Larry F. Babb, LaGrange; Michael J. Rutkowski, Brunswick, both of Ohio

[73] Assignee: Emerson Electric Co., St. Louis, Mo.

[21] Appl. No.: 482,034

[22] Filed: Feb. 20, 1990

[51] Int. Cl.[5] ..... B08B 1/00

[52] U.S. Cl. ..... 15/104.33; 15/104.31; 280/43.12; 280/43.14; 280/47.19; 384/281

[58] Field of Search ..... 15/104.31, 104.33; 280/43.1, 43.14, 47.12, 47.15, 47.19, 47.20, 47.21, 47.27, 47.28, 47.29, 47.33, 475; 384/281, 295, 396, 441

[56] References Cited

U.S. PATENT DOCUMENTS

| | | | |
|---|---|---|---|
| 2,468,490 | 4/1949 | DiJoseph | 15/104.30 |
| 2,730,740 | 1/1956 | O'Brien | 15/104.33 |
| 3,007,186 | 11/1961 | Olsson | 15/104.33 |
| 3,093,854 | 6/1963 | Silverman | 15/104.33 |
| 3,095,592 | 7/1963 | Hunt | 15/104.33 |
| 3,134,119 | 5/1964 | Criscuolo | 15/104.33 |
| 3,246,354 | 4/1966 | Cooney et al. | 15/104.33 |
| 3,394,599 | 7/1968 | Tucker | 74/25 |
| 3,605,158 | 9/1971 | Russell | 15/104.33 |
| 3,747,153 | 7/1973 | O'Neill | 15/104.33 |
| 3,883,150 | 5/1975 | Varela | 280/47.19 |
| 4,364,139 | 12/1982 | Babb et al. | 15/104.33 |
| 4,580,306 | 4/1986 | Irwin | 15/104.33 |
| 4,914,775 | 4/1990 | Kirk | 15/104.33 |

*Primary Examiner*—William A. Cuchlinski, Jr.
*Assistant Examiner*—J. Folker
*Attorney, Agent, or Firm*—Body, Vickers & Daniels

[57] ABSTRACT

A drain cleaning machine is disclosed which is of the character comprising a frame supporting a rotatable drum which is driven by a motor through an endless belt. The drum contains a flexible drain cleaning snake which is rotatable with the drum and axially displaceable into and out of the drum, and the frame supports a snake feeding device through which the snake extends and by which the snake is displaced into and out of the drum. The frame is wheeled to facilitate transportation of the machine from one location to another. The drum, drum shaft and bearing are constructed as a unit removably mounted on the frame. The drive motor is pivotally mounted on the frame and spring biased to tension the drive belt and to facilitate separation of the drive belt from the drum to facilitae removal of the drum unit from the frame. Stabilizer members are associated with the wheels on the frame and are pivotal between storage and use positions in which the wheels respectively engage an underlying surface and are elevated above the surface to stabilize the machine against rolling and tipping dipslacement during use. The snake feeding device includes three rollers which engage the snake to feed the latter inwardly and outwardly of the drum in response to rotation of the drum, and two of the rollers are radially adjustable relative to the snake through corresponding cam arrangements so that the feeding device can accommodate snakes having different diameters.

75 Claims, 7 Drawing Sheets

DRAIN CLEANING MACHINE

BACKGROUND OF THE INVENTION

This invention relates to sewer cleaning machines and, more particularly, to improvements in sewer cleaning machines of the character having a flexible plumbers cable or snake coiled within a rotatable drum from which the snake is withdrawn and inserted into a pipe or sewer to be cleaned and by which the snake is rotated to achieve such cleaning.

Drum type sewer cleaning machines of the character to which the present invention is directed are well known and are shown, for example, in U.S. Pat. Nos. 2,468,490 to DiJoseph; 3,095,592 to Hunt; 3,134,119 to Criscuolo; 3,246,354 to Cooney et al; 4,364,139 to Babb et al; and, 4,580,306 to Irwin. As will be seen from these patents, it is known to provide a drum type sewer cleaning machine comprising a frame structure supporting the rotatable snake drum and a drive motor arrangement for rotating the drum, and to provide for the drum to be removable from the frame and drive arrangement to, for example, facilitate replacement of the drum with one containing a snake having a different diameter. It will be further seen from the foregoing patents that such machines heretofore known often have wheels on the frames to facilitate rolling displacement of the machine from one location to another, and provide arrangements by which the wheels and frame or the frame alone supports the machine during use thereof. It will also be seen from these prior art patents that such drum type sewer cleaning machines may include a snake feeding arrangement supported by the frame and by which the snake or cable is adapted to be axially displaced relative to the drum during use of the machine.

Drum type sewer cleaning machines of the foregoing character heretofore known have a number of disadvantages attendant to the construction and use thereof. In this respect, for example, the arrangements heretofore provided for removal and replacement of the drum have been structurally complex and/or have required difficult and time consuming disassembly of component parts including the shaft supporting the drum for rotation and the bearing or bearings interposed between the shaft and drum. Moreover, such disassembly of these component parts subjects the bearings and/or support shaft to damage and/or to the ingress of dirt and other foreign matter which can produce undesirable wear upon reassembly and further use of the machine.

Another disadvantage resides in the structural interrelationship between the drum and the drive motor arrangement in those designs wherein the motor drives the drum through a roller or endless belt drivingly engaging the outer periphery of the drum. More particularly in this respect, the drive arrangement must be disengaged from the drum to facilitate removal of the drum from the frame, such as by removing the endless belt from the drum or displacing the roller from the drum. The arrangements heretofore provided in this respect have either required the cooperative efforts of two persons to achieve disengagement, have not provided desirable driving interengagement between the drum and its drive component and/or have required time consuming manual manipulation of component parts to achieve the release of the drive component. In connection with these disadvantages, for example, if the drive motor is fixed relative to the snake drum during use, as in the Criscuolo and Cooney et al patents mentioned above, it is difficult to obtain and constantly maintain uniform driving interengagement between the drive member and drum. In this respect, it is difficult to obtain a true circular contour for the drum in connection with the manufacture thereof. It is likewise difficult to obtain concentricity in connection with the mounting of the drum relative to the drum shaft about which it rotates. Either or both of these problems result in an eccentricity in the rotation of the drum which is not compensated for with a fixed motor arrangement. Further problems with regard to maintaining uniform frictional driving interengagement result from wear and stretching of the drive belt in an arrangement such as that of Cooney et al, and wear of the drive roll in an arrangement such as that of Criscuolo. While the latter problems can be overcome by a biased mounting of the motor, such as is shown in the patent to Hunt referred to above, such biasing arrangements heretofore provided are difficult to manipulate in connection with displacing the motor against the spring bias to release the belt. Thus, the cooperative effort of two persons is required to achieve detachment of the belt. This is due not only to the requirement to move the motor against the bias of two springs, but also to the fact that such movement involves the displacement of parallel support rods having a tendency to jam in the guide openings therefore.

Another disadvantage in sewer cleaning machines heretofore known resides in the snake feed mechanisms by which the plumbers snake is displaced outwardly and inwardly of the drum. Most often, the snake feeding mechanism is comprised of three rollers spaced apart to provide an opening through which the snake extends and which rollers are adapted to engage the snake so as to cause the latter to move inwardly or outwardly of the snake drum in response to rotation of the drum. Generally, two of the rollers are radially adJustable relative to the snake axis so as to enable the feed mechanism to accommodate snakes having different diameters. The third roller is generally spring biased so that the snake is firmly captured between the three rollers. heretofore, the arrangements by which the two rollers are adjustable have been structurally complex and/or have made it extremely difficult to obtain accurate adjustment of the two rollers relative to the axis of the feed mechanism. Structural complexity not only adds to the manufacturing cost but also often makes the operation of the mechanism cumbersome. The inability to obtain accurate adjustment of the rollers relative to the axis of the feed mechanism can result in an erratic action during use of the machine, and such action imposes undesirable wear on the component parts of the snake feeding mechanism and causes instability with respect to the support of the machine during operation thereof. Yet another disadvantage of sewer cleaning machines heretofore available relates to stabilizing the machines during use to minimize or preclude movement of the machine relative to an underlying support surface. In connection with those machines in which the frame is provided with wheels to support the machine for rolling movement along an underlying surface, the frame and wheels may be interrelated such that only the frame engages the underlying surface when the machine is in its use position. During use of the machine, the wheels are slightly elevated from the underlying surface, whereby a slight tilting of the machine from its use position provides for the wheels to engage the underlying surface to support the machine for rolling movement. Such an arrangement is shown in the patents to Babb et al and Cooney et al, mentioned above, and Cooney et al supplements such stabilizing by providing for the frame handle to be displaceable to a position engaging the underlying surface during use of the machine. Other arrangements such as shown in the patents to Hunt and Irwin provide for tilting the machine 90° about a wheel axis to a use position in which the frame or frame and wheels engage the underlying surface to stabilize the machine during use. Such prior arrangements either require a somewhat complex and heavy frame structure which adds to the cost of manufacture as well as the weight of the machine, and/or require undesirable manipulations of the machine between use and non-use positions which necessitate considerable physical effort on the part of the person using the machine. The latter is especially true where such tilting displacement is 90° about the wheel axis, whereby the user must exert considerable physical effort to stabilize the machine against rolling displacement along the underlying surface during such manipulation between the use and non-use positions in addition to bending over to lower the machine to or elevate the machine from the use position.

SUMMARY OF THE INVENTION

The foregoing and other problems and disadvantages attendant to sewer cleaning machines heretofore known are minimized or avoided in accordance with the present invention. More particularly in this respect, and in accordance with one aspect of the invention, a sewer cleaning machine is provided with a removable drum unit which includes the drum housing, the support shaft about which the drum rotates, and the bearing assembly which supports the drum for rotation relative to the drum shaft. The drum unit is removably mounted on the frame by means of a mounting member rigidly secured to the frame and to which the drum shaft is releasably secured such as by a threaded fastener arrangement. Advantageously, release of the drum assembly is readily achieved from behind the frame relative to the drum location, whereby removal and remounting operations are both readily and easily achieved. Further advantages are realized by avoiding separation of the component parts of the drum unit in connection with drum removal and mounting operations. In this respect, the component parts are neither subjected to physical damage by separation and reassembly nor exposed to dirt and other undesirable foreign matter during a removal and replacement operation.

In accordance with another aspect of the invention, the drive motor by which the drum is rotated about its axis is mounted on the machine frame for pivotal movement about a pivot axis offset from the motor shaft axis. The motor is biased relative to the pivot axis in the direction to promote driving engagement with the snake drum. Preferably, the drum is driven by the motor through an endless belt engaging about the outer periphery of the drum, whereby the bias against the drive motor is in the direction to tension the drive belt. The pivotal bias of the motor not only provides for maintaining a substantially uniform frictional driving interengagement between the belt and drum, but also allows separation of the belt from the drum to be obtained easily and quickly by one person, either in connection with replacement of the belt or removal and replacement of the drum from the frame. More particularly in this respect, a workman need only displace the drive motor about its pivot axis against the bias sufficiently to enable release of the drive belt from the drum, and the pivotal support of the motor facilitates such displacement.

In accordance with yet another aspect of the present invention, an improved three roller snake feeding mechanism advantageously provides for accurate radial adjustment of the snake feeding rollers and thus a snake therebetween in connection with adjustment of the feed mechanism to accommodate snakes having different diameters. More particularly in this respect, two of the three rollers of the snake feeding mechanism are provided with corresponding cams by which the roller is selectively and accurately positioned relative to the axis of the feed mechanism. Accordingly, the feed mechanism can be quickly adjusted to accommodate snakes having different diameters through an arrangement which is both structurally simple and accurate, whereby the cost of manufacture as well as the time required to make such an adjustment is advantageously reduced. Moreover, the accuracy of adjustment enables minimizing wear and damage to the component parts of the feed mechanism during use of the machine.

In accordance with still another aspect of the invention, a structurally simple stabilizing mechanism is provided for the wheeled frame of a sewer cleaning machine to stabilize the machine against undesirable displacement relative to an underlying support surface during use of the machine. The stabilizing mechanism is pivotally displaceable between storage and use positions and, preferably, is biased to the storage position. In the storage position, the machine is supported by the wheels and a portion of the machine frame engaging the underlying surface, and in the use position of the stabilizing mechanism, the latter engages the underlying surface together with the portion of the machine frame to support the machine with the wheels elevated above the support surface and thus against rolling movement during use. Preferably, the stabilizing mechanism engages the underlying surface behind the wheels, thus shifting the center of gravity of the machine forwardly to stabilize the machine against tilting rearwardly during use.

It is accordingly an outstanding object of the present invention to provide an improved sewer cleaning machine of the character comprising a frame supporting a rotatable plumbers snake drum from: which a snake is withdrawn and by which the snake is rotated to achieve a sewer cleaning operation.

Another object is to provide a sewer cleaning machine with a snake drum unit and an arrangement for removably mounting the drum unit on the machine frame.

A further object is the provision of a sewer cleaning machine having a drum unit and mounting arrangement by which the component parts of the drum unit are protected from damage and exposure in connection with drum removal and replacement operations.

Still another object is the provision of a sewer cleaning machine having an improved drive arrangement for the drum which facilitates separation of the drum driving component from the drum in connection with removal of the driving component and/or removal and replacement of the drum.

Yet a further object is the provision of a sewer cleaning machine having an improved drive arrangement of the foregoing character in which the drive motor is pivotally mounted on the machine and biased to promote driving engagement between the drum and driven component, thus to facilitate the quickness and ease with which the drive motor can be manipulated to achieve separation of the driving component from the drum.

Still another object of the present invention is the provision of a sewer cleaning machine with an improved roller type snake feeding arrangement for displacing a plumbers snake relative to the snake drum of the machine and in which the snake engaging rollers are adjustable to accommodate snakes having different diameters.

Still another object is the provision of a sewer cleaning machine having an improved snake feeding mechanism of the foregoing character in which snake engaging rollers are readily and selectively adjustable to fixed positions relative to the axis of the feed mechanism by corresponding adjusting cams, thus to minimize the time required for adjustment and to optimize the accuracy of adjustment.

Still a further object of the present invention is the provision of a sewer cleaning machine with a machine frame provided with wheels to facilitate rolling displacement of the machine along an underlying surface and an improved stabilizing arrangement for elevating the wheels above the underlying surface to stabilize the machine against displacement during use.

Yet a further object is the provision of a sewer cleaning machine with an improved stabilizing arrangement pivotal relative to the machine between storage and use positions and are biased to the storage position and which, in the use position, stabilizes the machine against rolling and tilting relative to an underlying surface.

Another object is the provision of an improved sewer cleaning machine which is comprised of a minimum number of component parts structurally interrelated so as to minimize the cost of the machine while improving functional aspects regarding protection of the component parts of the snake drum, accommodation of snakes having different diameters, stabilizing of the machine during a sewer cleaning operation, and facilitating the ease of and minimizing the number of component parts manipulated in connection with removal and replacement of the snake drum.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF A PREFERRED EMBODIMENT

Figure 1:
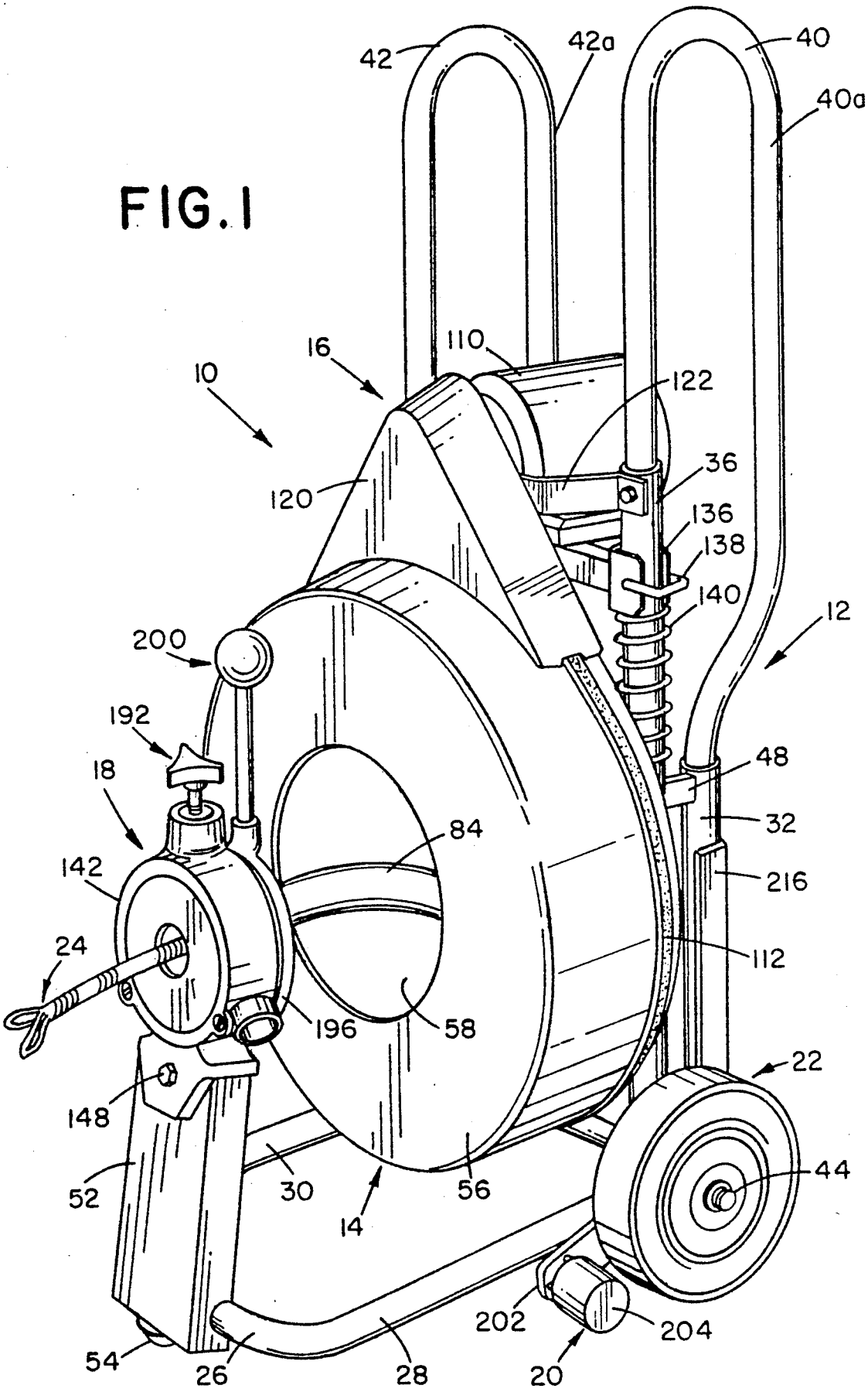
FIG. 1 is a perspective view of a sewer cleaning machine according to the present invention.
Figure 2:
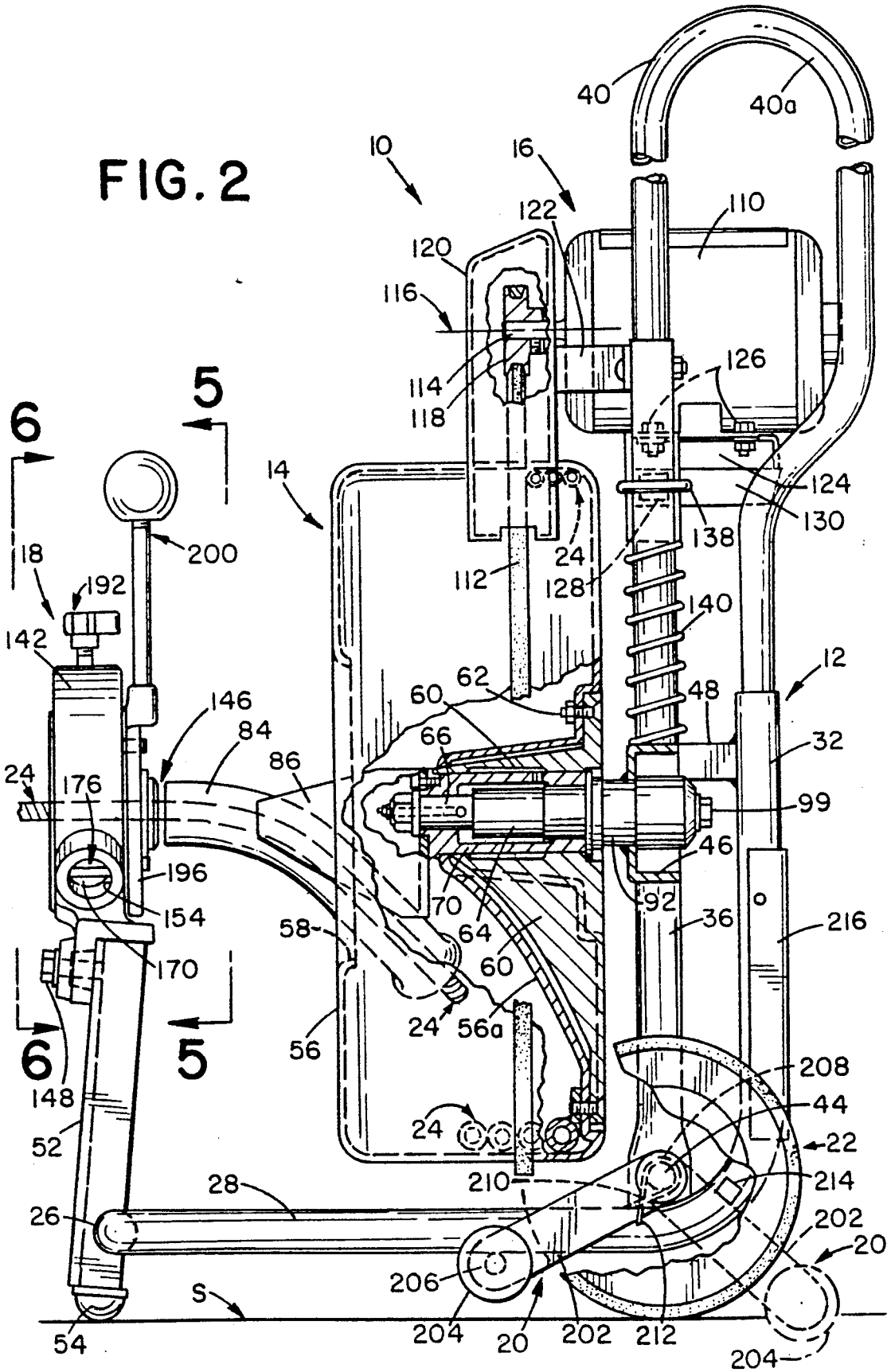
FIG. 2 is a side elevation view, partially in section, of the machine shown in FIG. 1.
Figure 3:
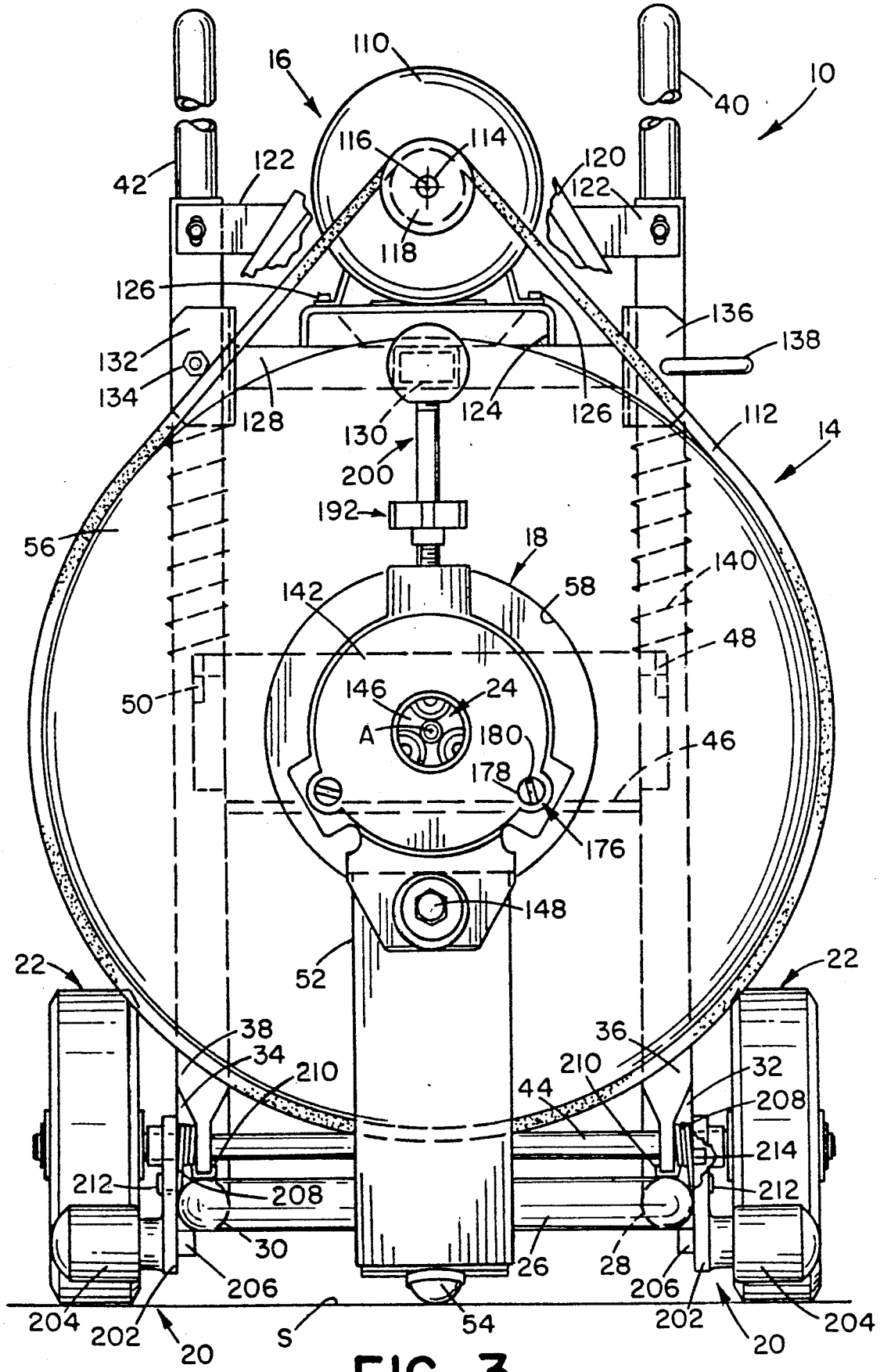
FIG. 3 is an end elevation view of the machine looking in the direction from left to right in FIG. 1, and showing the drive belt guard removed.

With reference now to the drawings, wherein the showings are for the purpose of illustrating a preferred embodiment of the invention only and not for the purpose of limiting the invention, a portable sewer cleaning machine 10 is shown in FIGS. 1-3 as comprising a wheeled frame assembly 12 supporting a rotatable snake drum unit 14, a drum driving arrangement 16, a snake feeding mechanism 18, and machine stabilizer components 20. Frame assembly 12 is provided with a pair of wheels 22 by which machine 10 is adapted to be supported for rolling movement from one location to another along an underlying surface S, and drum unit 14 contains a flexible plumbers snake 24 which extends outwardly through feed mechanism 18 and which is adapted to be rotated and displaced inwardly and outwardly relative to the drum unit during operation of the machine, as set forth more fully hereinafter.

Frame assembly 12 is basically of tubular construction and includes a bottom member having a laterally extending leg 26 at the front end of the machine and a pair of rearwardly extending legs 28 and 30 terminating at the rear end of the machine in upwardly extending legs 32 and 34, respectively. The rear portion of the frame assembly further includes a pair of upstanding legs 36 and 38 respectively secured at their lower ends to legs 28 and 30, such as by welding. The upper ends of legs 32 and 36 are interconnected by an inverted U-shaped handle member 40, and the upper ends of legs 34 and 38 are interconnected by an inverted U-shaped handle member 42 The lower ends of legs 36 and 38 are apertured to receive an axle member 44 which is suitably secured thereto such as by welding, and legs 36 and 38 are further laterally interconnected intermediate their upper and lower ends by a channel member 46 having its laterally opposite ends suitably connected to legs 36 and 38 such as by welding. Legs 32 and 36 on one side of the frame assembly are interconnected near the upper end of leg 32 by a tie bar 48 secured thereto such as by welding, and legs 34 and 38 are similarly interconnected by means of a tie bar 50. The front of frame assembly 12 includes an upstanding channel-shaped member 52 which is notched adjacent its lower end to receive frame leg 26 and which is secured to the latter frame leg such as by welding, and the lower end of member 52 is preferably provided with a rest button 54 which engages underlying surface S.

Figure 4:
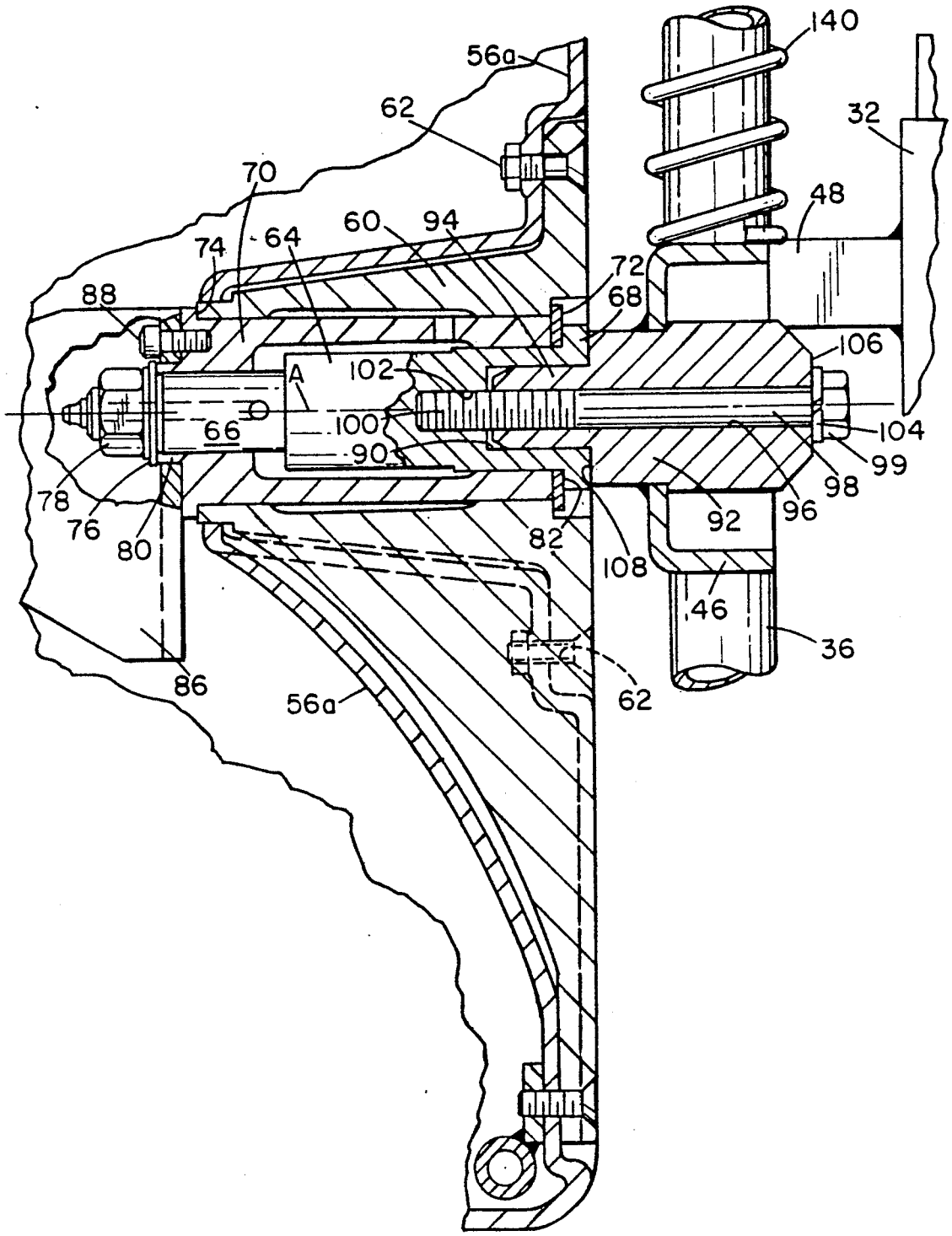
FIG. 4 is a detailed sectional elevation view of a portion of the drum and frame of the machine.

As best seen in FIGS. 2, 3 and 4 of the drawing, snake drum unit 14 includes a drum housing 56 having an opening 58 in the front wall thereof and having its rear wall **56*a* contoured to receive a hub member 60 to which the housing is secured by means of a plurality of nut and bolt assemblies 62. Drum unit 14 further includes a drum shaft 64 having an outer end 66 and an inner end 68, and a spindle bearing 70 radially interposed between shaft 64 and hub 60. A thrust bearing 72 is axially interposed between a shoulder 82 on inner end 68 of shaft 64 and the corresponding end of bearing 70, and the outer end of spindle bearing 70 has a shoulder 74 which cooperates with thrust bearing 72 to axially capture hub 60 and thus drum housing 56 relative to bearing 70. Outer end 66 of shaft 64 receives a retaining washer 76 and retaining nut 78, and washer 76 faces the outermost end 80 of bearing 70 and cooperates with thrust bearing 72 and shoulder 82 on inner end 68 of shaft 64 to axially capture bearing 70 and thus hub 60 and drum housing 56 on drum shaft 64. Bearing sleeve 70 is rotatable relative to shaft 64 and to hub 60 and, preferably, a snake guide tube member 84 is secured to the outer end of bearing 70 for rotational displacement therewith by means of a mounting bracket 86 welded to guide tube 84 and mounted on bearing 70 by means of a cap screw 88. As is well known, drum housing 56 contains the coiled spring wire plumbers snake 24, and guide tube 84 serves to guide displacement of the snake into and out of housing 56** during use of the machine and in a manner which provides for the snake to be coiled and uncoiled during its displacement relative to the housing. While the guide tube is illustrated and described herein as being a part of the drum unit, this is merely a preferred arrangement and the guide tube could be supported adjacent its axially outer end for rotation, in which case it would be free of a mounted interconnection with the drum unit. Further, while the drum housing and hub are preferably separate components assembled as described hereinabove, the drum housing could be constructed so as to provide a hub portion integral therewith.

In accordance with one aspect of the present invention, the drum unit including at least the drum shaft, bearing and drum housing is a unitary assembly adapted to be removably mounted on frame assembly 12 to facilitate removal and replacement of the drum unit. As best seen in FIG. 4, such mounting is achieved in accordance with the preferred embodiment by providing axially inner end 68 of drum shaft 64 with a circular recess 90, and by providing frame assembly 12 with a drum mounting member 92 having a projection 94 at its axially outer end received in recess 90 of shaft 64. Drum mounting member 92 is fixedly secured to channel-shaped cross member 46 of the frame assembly, such as by welding, 25 and is provided with a bore 96 extending axially therethrough to receive the shank of a bolt 98 having a head 99 and a threaded end 100 received in a threaded bore 102 opening into shaft 64 from recess 90 therein. Preferably, a lock washer 104 is interposed between head 99 and the axially inner end 106 of drum mounting member 92. Projection 94 on the axially outer end of drum mounting member 92 provides a shoulder 108 on the mounting member, and it will be appreciated from the drawings and the foregoing description that bolt 98 secures drum shaft 64 to mounting member 92 against rotation relative thereto, and that the drum housing and bearing sleeve 70 are thus rotatable relative to drum shaft 64 about a drum axis A provided by the drum shaft. It will likewise be appreciated that head 99 of bolt 98 is readily accessible from the rear end of the frame assembly and that the drum unit is readily released for removal from the frame assembly simply by disconnecting bolt 98 from shaft 64. Removal of the drum unit in the preferred embodiment requires removal of the snake feeding mechanism 18 which, as will become apparent hereinafter, is likewise easily and quickly achieved by removal of a single bolt member. It will b®appreciated, however, that if sufficient clearance exists between the outer end of guide tube 84 and the snake feeding mechanism, removal of the latter would not be necessary in order to remove the drum unit.

As best seen in FIGS. 1–3 of the drawings, drive unit 16 of the sewer cleaning machine includes an electric drive motor 110 which is adapted to drive an endless belt 112 which engages about the outer periphery of drum housing 56 to achieve rotation of the latter. Further in this respect, motor 110 has a drive shaft 114 rotatable about a drive shaft axis 116 and provided with a drive pulley 118 about which belt 112 is trained, whereby the belt is driven in response to rotation of shaft 114 to rotate drum housing 56. Preferably, pulley 118 and the portion of belt 112 exposed above drum housing 56 is covered, for protective purposes, by a guard 120 which is removably secured to frame legs 36 and 38 by a guard mounting bracket 122.

As best seen in FIGS. 2 and 3, motor 110 is pivotally supported on frame assembly 12 by means of an arm assembly including a mounting bracket 124 to which the motor is secured by a plurality of nut and bolt assemblies 126. Bracket 124 is secured such as by welding to a supporting arm including a laterally extending tubular support member 128 and a rearwardly extending tubular support member 130 connected to member 128 intermediate the opposite ends of the latter. One end of tubular member 128 is provided with a laterally outwardly open U-shaped bracket 132 welded to the corresponding end of member 128 and receiving leg 38 of the frame assembly between the flanges thereof. The arm assembly is pivotally secured to leg 38 for displacement about a pivot axis parallel to and offset from motor drive shaft axis 116 by means of a nut and bolt assembly 134. The opposite end of tubular member 128 is provided with a laterally outwardly open U-shaped bracket 136 which is welded to the corresponding end of member 128 and receives leg 36 of the frame assembly between the flanges thereof. Bracket 136 is provided with a laterally outwardly extending handle 138 suitably secured thereto such as by welding and by which the arm assembly and thus motor 110 is adapted to be pivoted about the axis provided by nut and bolt assembly 134. A coiled compression spring 140 surrounds leg 36 of the frame assembly between the lower end of bracket 136 and the upper side of cross member 46 of the frame assembly to bias the motor supporting arm assembly upwardly in FIGS. 2 and 3 and thus counterclockwise in FIG. 3 about nut and bolt assembly 134 to tension drive belt 112.

The pivotal supporting arrangement for the drive motor advantageously provides a uniform frictional engagement between the outer surface of snake drum 56 and drive belt 112 to accommodate any eccentricity between the outer surface of the drum and drum axis A resulting from assembly of the component parts of the drum unit and/or the inability to get a truly circular outer contour in connection with manufacturing the drum housing 56. Importantly too, the pivotal mounting arrangement advantageously enables one person alone to achieve disassembly of the drive belt and drum in connection with removal of the drum from the frame assembly. In this respect, a person can easily displace the supporting arm assembly downwardly against the bias of spring 140 with one hand to enable separation of belt 112 from housing 56 with the other hand. In a similar manner, a person can easily displace the arm assembly downwardly to achieve replacement of the belt about the drum housing following removal and replacement of the drum unit and/or replacement of the drive belt. The pivotal support arm arrangement and the use of a single biasing spring also advantageously provides for obtaining the tensioning of the drive belt and allowing for the release of tension for removal of the belt without any binding interference between the motor support and frame components.

Referring now to FIGS. 1–3 and 5–8, snake feeding mechanism 18 includes a feed housing 142 having an opening 146 therethrough coaxial with axis A and through which snake 24 extends. Housing 142 is secured to the upper end of front frame member 52 by means of a single bolt 148 whereby it will be appreciated that the snake feeding mechanism is readily detachable from the frame. Housing 142 is provided with three radially extending circular chambers 150, 152 and 154 equally spaced apart circumferentially with respect to axis A, and each of the chambers 150, 152 and 154 opens radially into opening 146 and supports a corresponding cylindrical body 156, 158 and 160 for radial displacement relative to axis A and for pivotal displacement relative to the axis of the corresponding chamber. Body members 156, 158 and 160 have radially inner ends provided with rollers 162, 164 and 166, respectively, mounted on the corresponding body member for rotation about an axis transverse to the chamber axis and which, as will become apparent hereinafter, is adapted to be parallel to or skewed relative to axis A.

Figure 7:
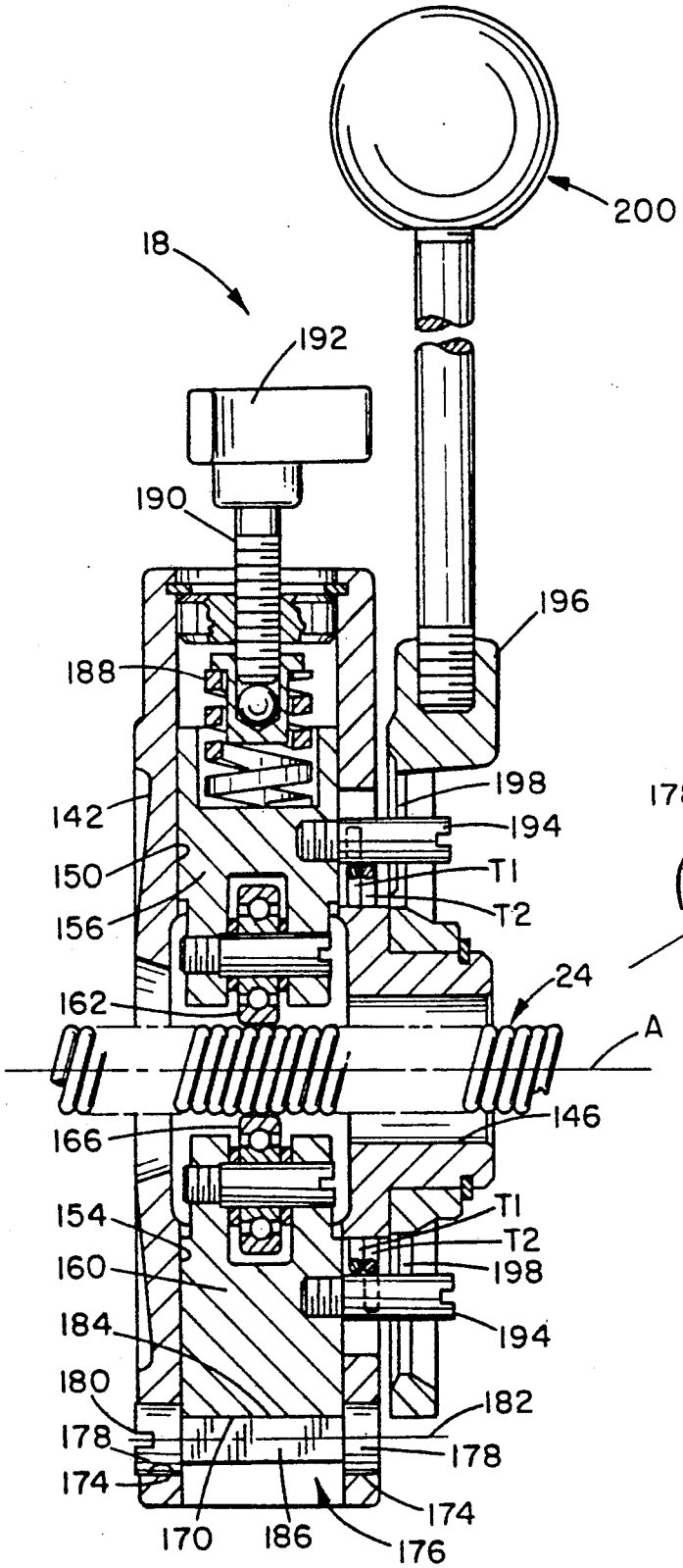
FIG. 7 is a sectional elevation view of the feed mechanism taken along line 7—7 in FIG. 6; and, FIG. 8 is a perspective view of an adjusting cam for the feed mechanism.
Figure 8:
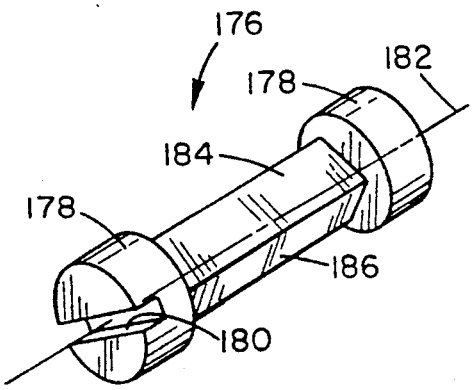

Each of the body members 158 and 160 has a radially outer end defined by a planar surface 168 and 170, respectively, and feed housing 142 is provided with bores 172 and 174 extending transversely across the outer end of chambers 152 and 154, respectively, parallel to axis A. Each of the bores 172 and 174 receives a rotatable cam member 176 which, as shown in FIG. 8, has enlarged, circular ends 178 received in the bores of the corresponding chamber, and the axially outer one of which ends is provided with a screwdriver slot 180 for rotating the cam member. Each of the cams 176 is rotatable about a corresponding axis 182 and is provided between ends 178 with planar cam surfaces 184 and 6, which cam surfaces are parallel to axis 182 but spaced a different distance therefrom. As will be appreciated from FIG. 7, the axial distance between ends 178 of cam member 176 corresponds to the diameter of chambers 152 and 154, whereby the planar outer end surface of body members 158 and 160 are adapted to facially engage one of the cam surfaces 184 and 186, depending on the disposition of cam 176 relative to the corresponding chamber. As shown in FIG. 7, cam surface 184 is engaged by the radially outer end of body member 160 and, as will become apparent hereinafter, the cam member 176 in chamber 152 would have the same orientation relative to body member 158. In the embodiment illustrated, the portion of cam 176 between ends 178 is rectangular in cross-section, whereby cam surface 184 is wider than cam surface 186 and the latter cam surface is spaced further from axis 182 than cam surface 184. With further regard to the embodiment illustrated, it will be appreciated that the rectangular configuration of the portion between ends 178 provides for a pair of opposed surfaces 184 and a pair of opposed surfaces 186. In the preferred embodiment, the opposed surfaces are symmetrical with respect to axis 182, whereby it will be appreciated that cam 176 has two selectable positions relative to the corresponding one of the body members 158 and 160. It will be appreciated, however, that such symmetry is not necessary, and that it is possible to provide more than two planar cam surfaces between ends 178 each being spaced a different distance from axis 182.

As will be appreciated from the foregoing description and FIG. 7 of the drawing, each of the cams 176 is axially retained relative to the corresponding one of the chambers and 154 by engagement of the radially outer end of the corresponding body member 158 and 160 against the cam surface between ends 178 of the cam member. As will be further appreciated from FIGS. 7 and 8 of the drawing, cam members 176 are adapted to be rotated 90° about axis 182 to selectively position the corresponding one of the rollers 64 and 166 relative to axis A in either one of the two radial positions provided by cam surfaces 184 and 186, thus enabling the feed mechanism to accommodate snakes having different diameters. Further in connection with accommodating snakes having different diameters, body member 156 for roller 162 is mounted in chamber 150 of the feed housing for radial adjustment relative to axis A and for spring biased displacement radially inwardly of chamber 150. More particularly in this respect, a biasing compression spring 188 is provided between the radially outer end of body member 156 and the radially inner end of an adjusting screw component 190 having a handle 192 for adjusting the compression of spring 188 and thus the pressure exerted on snake 24 by rollers 162, 164 and 166.

Each of the body members 156, 158 and 160 is provided with a pin 194 extending axially toward drum unit 14 parallel to axis A, and snake feeding mechanism 18 further includes an actuator plate 196 mounted on feed housing 142 for pivotal movement about axis A. Plate 196 is provided with a radially extending slot 198 for each of the pins 194 and through which the corresponding pin extends. Actuating plate 196 is provided with an operating handle 200 by which the plate is adapted to be pivoted in opposite directions about axis A. When handle 200 is in the vertical position shown in the drawings, the axis of rotation of each of the rollers 162, 164 and 166 is parallel to axis A to define an idling position for the feed mechanism in which snake 24 is not axially displaced in either direction in response to rotation of the drum. When operating handle 200 is displaced in either of the opposite directions relative to axis A, slots 198 engage pins 194 to pivot the corresponding roller supporting body member about the axis of the corresponding chamber to skew the roller axes relative to axis A, whereby rotation of snake 24 results in the snake being fed axially inwardly or outwardly of the snake drum depending on the position of handle 200.

Figure 5:
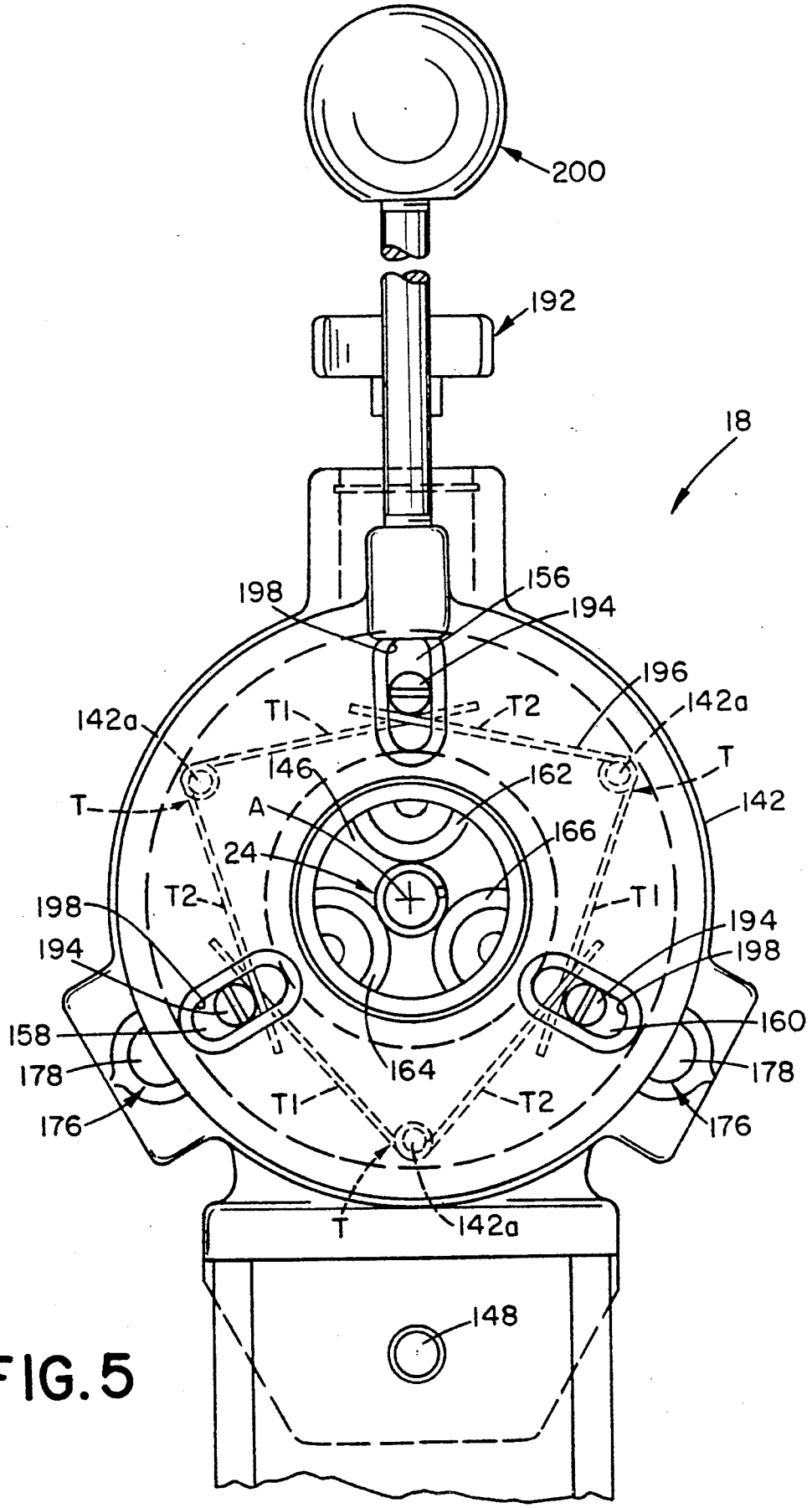
FIG. 5 is an elevation view of the snake feed mechanism taken along line 5—5 in FIG. 2.
Figure 6:
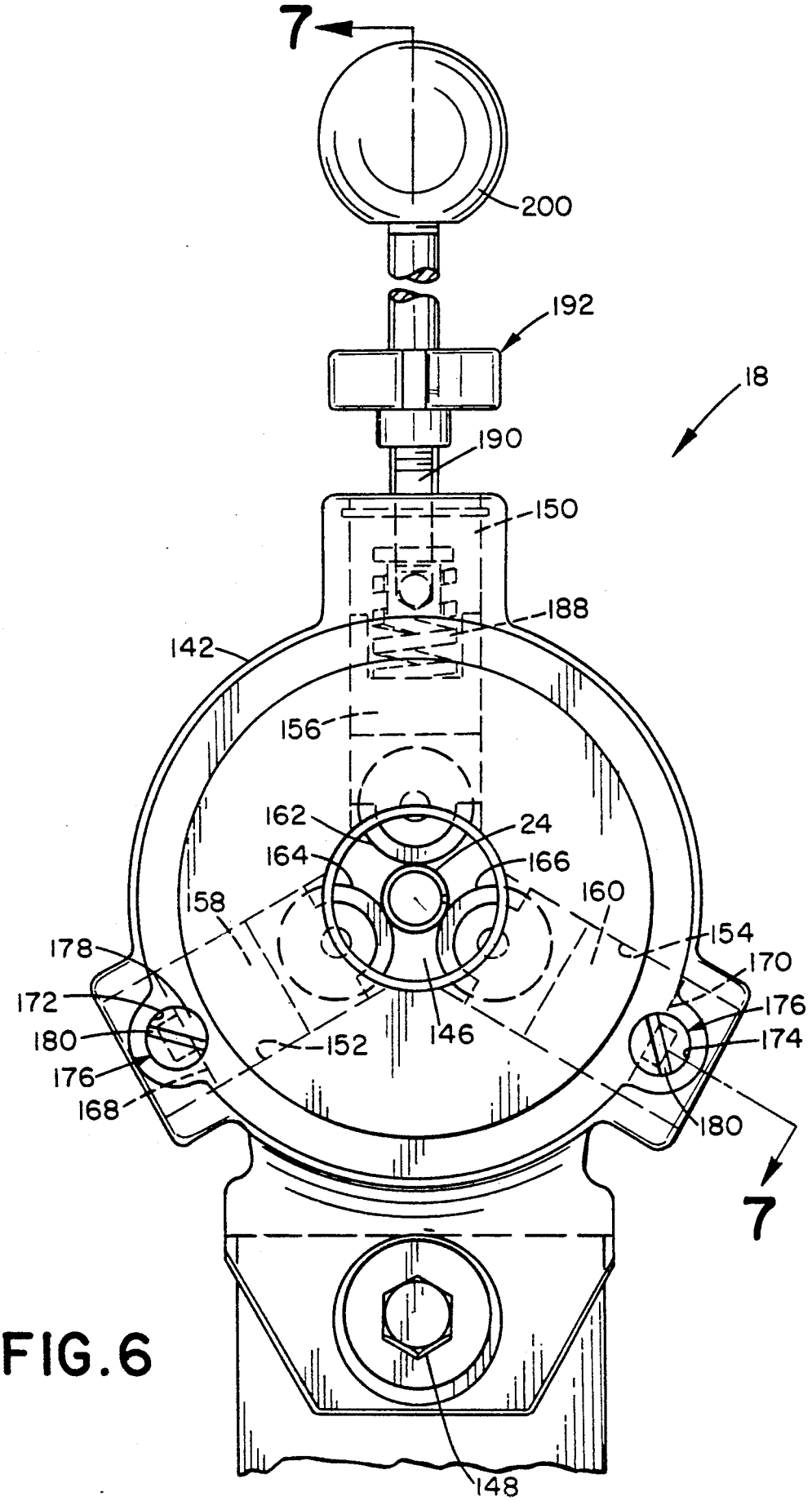
FIG. 6 is an elevation view of the snake feeding mechanism taken along line 6—6 in FIG. 2.

Preferably, as will be appreciated from FIGS. 5 and 7, feed housing 142 is provided with mounting posts **142*a* circumferentially between the chambers for rollers 162, 164 and 166 and each of which posts receives and supports a torsion spring T having legs T1 and T2 respectively extending clockwise and counterclockwise from the corresponding post 142*a* in FIG. 5. Legs T1 and T2 of each spring T engage against the radially inner sides of the circumferentially adjacent pins 194, whereby the legs T1 and T2 of circumferentially adjacent springs T cooperatively engage against the pin 194 therebetween. Such engagement imposes a radially outward bias against the pin as well as a circumferential centering bias. The radially outward bias against pins 194 of roller supporting body members 158 and 160 advantageously biases the radially outer ends of the body members against the corresponding cam 176 to maintain the cam in a given position and to preclude unintended rotative or axial displacement of the cam relative to the corresponding bore 174. More particularly in this respect, for example, if snake 24 is removed from the feed mechanism springs T prevent displacement of body members 158 and 160 radially inwardly of the corresponding chamber and thus preclude a separation of the body member from engagement with the cam which would release the cam to freely rotate and/or axially slide relative to its bore 174. The circumferential centering bias of springs T with respect to pins 194 assists in returning the rollers 162, 164 and 166** to the neutral positions thereof following a snake feeding operation.

It will be appreciated from the foregoing description of the snake feeding mechanism that cams 176 and the corresponding roller supporting body members provide a structurally simple arrangement for changing the radial positions of rollers 164 and 166 relative to axis A. Such changing between either one of the two positions is achieved simply by turning each of the cam members 90° through the use of a screwdriver, and the cams provide for the accurate positioning of the rollers relative to axis A. Thus, the imposition of undesirable radial forces on the component parts of the feed mechanism during operation of the machine is minimized.

With reference once again to FIGS. 1–3 of the drawing, wheels 22 are mounted on the opposite ends of axle 44, and the wheels and rest button 54 at opposite ends of the frame assembly engage underlying surface S to support the machine in a rest position as shown in FIG. 2. While the machine can be used in the rest position, stabilizers 20 advantageously provide for stabilizing the machine against displacement relative to underlying surface S during the performance of a sewer cleaning operation. In the preferred embodiment shown, stabilizers 20 are provided inwardly adjacent each of the wheels 22 and are adapted to be displaced relative to the wheels and frame assembly between storage and use positions which are respectively shown by the solid line and broken line positions of stabilizer 20 in FIG. 2. Each of the stabilizers 20 includes a stabilizer arm 202 extending radially from axle 44 and having an apertured inner end received on the axle between the corresponding wheel 22 and the corresponding one of the frame legs 36 and 38. The outer end of each arm 202 extends beyond the outer periphery of wheel 22 and is provided with a foot 204 which extends laterally outwardly across the wheel. The outer end of each arm 202 is further provided with a laterally inwardly extending projection 206 which engages under the corresponding one of the frame legs 28 and 0 when the stabilizer is in its storage position.

Each stabilizer is biased to the storage position by a corresponding coil spring 208 which surrounds axle 44 between arm 202 and the corresponding one of the frame legs 36 and 38. Each coil spring 208 has an inner end 210 engaging the corresponding one of the frame legs 36 and 38 and an outer end 212 engaging the corresponding stabilizer arm 202, and it will be appreciated that each of the coil springs is wound so as to bias arm 202 to the storage position thereof. As will be appreciated from FIGS. 2 and 3, each of the frame legs 28 and 30 is provided in the bend thereof adjacent the rear of the frame assembly with a stop block 214 which projects laterally outwardly from the frame member into the path of movement of the corresponding arm 202 when the latter is displaced from its storage to its use position, whereby the arm engages and is stopped by projection 214 in the use position.

As will be appreciated from the broken line position of the stabilizer 20 in FIG. 2 of the drawing, when the stabilizers are in the use positions, feet 204 thereof will engage the underlying surface S and will cooperate with rest button 54 at the front end of the frame assembly to support the sewer cleaning machine with wheels 22 slightly elevated above the underlying support surface. This stabilizes the machine against rolling displacement relative to surface S during use. Preferably, as provided by the preferred embodiment, stabilizer feet 204 in the use position are behind wheels 22. This in effect shifts the center of gravity of the machine forwardly relative to the point of support at the rear of the machine and advantageously stabilizes the machine against tilting rearwardly during use. In this respect, for example, a considerable rearward force can be imposed on the machine if a person manually pushes the snake back into the drum, and the positioning of feet 204 behind wheels 22 optimizes precluding rearward tilting as a result of such force.

Each stabilizer is readily displaced from the storage to the use position by laterally tilting the machine to elevate the corresponding wheel 22 and then pushing foot 204 beneath the elevated wheel to the use position. The stabilizers are maintained in the use position by the weight of the machine against the bias of springs 208, and each stabilizer is returned to the storage position simply by tilting the machine to allow foot 204 to move beneath the wheel under the influence of spring 208.

While it is preferred to mount the stabilizer arms on the wheel axle, it will be appreciated that the arms could be mounted on the frame assembly for pivotal movement about an axis parallel to but offset from the wheel axis. Further, while it is preferred to provide for the stabilizers adjacent each of the wheels to be independently displaceable relative to the frame assembly, it will be appreciated that the stabilizer arms could be laterally interconnected, such as by a connecting rod between projections 206, so as to be displaceable as a unit.

Preferably, upwardly extending frame legs 32 and 34 are provided with channel-shaped skid strips, such as the strip 216 shown in FIGS. 1 and 2 on frame leg 32, to facilitate displacement of the machine upwardly and downwardly relative to a stairway. Further, as best seen in FIGS. 1 and 2, handle portions 40 and 42 of the frame assembly have corresponding portions **40*a* and 42*a* offset rearwardly from legs 32 and 34 beyond the rearward most extent of motor 110. These portions of the handles advantageously facilitate displacing the machine as a unit vertically onto or off of a truck bed or the like using the handle portions as skids. The handle portions not only protect the motor in connection with such displacement of the machine but also against engagement with the underlying surface should the machine be tilted completely around the axis of wheels 22 such that the handle portions 40*a* and 42*a*** engage the underlying surface.

While considerable emphasis has been placed herein on the specific structures and structural interrelationships between component parts of the sewer cleaning machine, it will be appreciated that changes can be made in the structures and structural interrelationships without departing from the principles of the present invention. In this respect, for example, while it is preferred to removably mount the drum unit on the frame using headed bolt 98, it will be appreciated that a rod could be suitably secured to drum shaft 64 and provided with a threaded end to receive a nut which would function in the manner of bolt head 99 to releasably mount the drum shaft to mounting member 92. It will likewise be appreciated that the projection and recess interengagement between shaft 64 and mounting member 92 can be reversed. Further, while it is preferred to spring bias the stabilizers to their stored positions, they could be releasably latched in the latter positions without such biasing. These and other modifications as well as other embodiments of the invention will be suggested or obvious to those skilled in the art upon reading the foregoing description of the preferred embodiment, whereby it is to be distinctly understood that the foregoing descriptive matter is to be interpreted merely as illustrative of the invention and not as a limitation.

Having thus described the invention, it is claimed:

1. A sewer cleaning machine comprising frame means, drum unit means, and means removably mounting said drum unit means on said frame means, said drum unit means including a drum shaft providing a drum axis, drum housing means coaxially surrounding said drum shaft, bearing means between said drum housing means and said drum shaft and supporting said drum housing means for rotation relative to said drum shaft about said drum axis, and means interconnecting said drum shaft, drum housing means and bearing means as a unitary assembly removably from said frame means, said means removably mounting said drum unit means on said frame means including mounting member means rigidly secured to said frame means and means releasably securing said drum shaft to said mounting member means.

2. A sewer cleaning machine according to claim 1, wherein said mounting member means has an outer end and said drum shaft has an inner end, said means releasably securing said drum shaft to said mounting member means including axially interengaging recess and projection means on said inner end of said drum shaft and said outer end of said mounting member means.

3. A sewer cleaning machine according to claim 1, wherein said means releasably securing said drum shaft to said mounting member means includes threaded fastener means coaxial with said drum axis and axially interconnecting said drum shaft and said mounting member means.

4. A sewer cleaning machine according to claim 3, wherein said mounting member means has an outer end and said drum shaft has an inner end, said means releasably securing said drum shaft to said mounting member means including axially interengaging recess and projection means on said inner end of said drum shaft and said outer end of said mounting member means.

5. A sewer cleaning machine according to claim 4, wherein said recess and projection means includes a recess in said inner end of said drum shaft and a projection on said outer end of said mounting member means received in said recess.

6. A sewer cleaning machine according to claim 5, wherein said mounting member means has an inner end and an opening axially therethrough between said inner and outer ends thereof, and said threaded fastener means includes bolt means extending through said opening and having head means engaging said inner end of said mounting member means.

7. A sewer cleaning machine according to claim 1, wherein said bearing means is rotatable relative to said drum shaft and said drum housing means is rotatable relative to said bearing means, said drum unit means further including snake guide tube means mounted on said bearing means for rotation therewith.

8. A sewer cleaning machine according to claim 1, and means to rotate said drum housing means including motor means having output shaft means rotatable about a shaft axis parallel to said drum axis and drive means driven by said output shaft means for frictionally engaging said drum housing means to rotate said drum housing means, said motor means being mounted on said frame means for pivotal displacement about a mounting axis parallel to and offset from said shaft axis and said drum axis, and spring means biasing said motor means to pivot about said mounting axis in the direction for said drive means to engage said drum housing means, said motor means being pivotal about said mounting axis in the direction opposite said direction to disengage said drive means and drum housing means for removal of said drum unit means from said frame means.

9. A sewer cleaning machine according to claim 8, wherein said drum housing means has an outer surface coaxial with said drum axis and said drive means includes endless belt means frictionally engaging said outer surface of said drum housing means, said spring means biasing said motor means in the direction to tension said belt means.

10. A sewer cleaning machine according to claim 1, wherein said frame means includes wheel means and support means for engaging an underlying surface to support said machine in a first position, and stabilizing means mounted on said frame means for pivotal displacement between storage and use positions relative thereto, said stabilizing means in said storage position being spaced above said underlying surface and in said use position engaging said underlying surface and cooperating with said support means to support said machine in a second position in which said wheel means is spaced above said underlying surface.

11. A sewer cleaning machine according to claim 10, and means biasing said stabilizing means toward said storage position.

12. A sewer cleaning machine according to claim 10, wherein said wheel means has an axis and said stabilizing means includes arm means pivotal about an arm axis parallel to said wheel means axis, said arm means having end means spaced from said arm axis and engaging said underlying surface in said use position of said stabilizing means.

13. A sewer cleaning machine according to claim 12, wherein said arm axis coincides with said wheel means axis.

14. A sewer cleaning machine according to claim 12, and spring means biasing said arm means toward said storage position of said stabilizing means.

15. A sewer cleaning machine according to claim 14, wherein said arm means and said frame means include means interengaging to stop said arm means respectively in said storage and use positions.

16. A sewer cleaning machine according to claim 15, wherein said arm axis coincides with said wheel means axis.

17. A sewer cleaning machine according to claim 1, wherein said drum housing means has axially inner and outer ends, flexible snake means in said housing means rotatable therewith and axially displaceable inwardly and outwardly of said housing means relative to said outer end thereof, and snake feeding means mounted on said frame means outwardly of said drum housing means for displacing said snake means axially relative to said drum housing means, said snake feeding means including feed housing means having an opening therethrough coaxial with said drum axis and through which said snake means extends, first, second and third snake engaging roller means in said opening, means including corresponding cam means supporting each said first and second roller means in said feed housing means in a selected one of at least first and second different snake engaging positions each radially fixed relative to said drum axis for said snake feeding means to accommodate snake means having different diameters, and means for biasing said third roller means into pressure engagement with said snake means.

18. A sewer cleaning machine according to claim 17, wherein said means supporting said first and second roller means includes corresponding radially extending chamber means in said feed housing means and corresponding body member means radially displaceable in said chamber means and having radially outer end surface means, each said corresponding cam means extending transversely across the corresponding chamber means and being supported for rotation about a cam axis, and said cam means having cam surface means engaging said radially outer end surface means.

19. A sewer cleaning machine according to claim 18, wherein said radially outer end surface means is planar, and said cam surface means includes at least two planar cam surfaces parallel to said cam axis and each spaced a different distance therefrom.

20. A sewer cleaning machine according to claim 18, and means supporting said third roller means including corresponding radially extending chamber means in said feed housing means and body member means radially displaceable therein, said body member means of each said first, second and third roller means including pin means extending therefrom parallel to said drum axis, actuator means supported on said feed housing means for pivotal displacement in opposite directions about said drum axis, said actuator means including means interengaging with said pin means to simultaneously pivot each said body member means in the corresponding chamber means in response to pivotal movement of said actuator means about said drum axis.

21. A sewer cleaning machine according to claim 20, wherein said radially outer end surface means is planar, and said cam surface means includes at least two planar cam surfaces parallel to said cam axis and each spaced a different distance therefrom.

22. A sewer cleaning machine according to claim 1, and means to rotate said drum housing means including motor means having output shaft means rotatable about a shaft axis parallel to said drum axis and drive means driven by said output shaft means for frictionally engaging said drum housing means to rotate said drum housing means, said motor means being mounted on said frame means for pivotal displacement about a mounting axis parallel to and offset from said shaft axis and said drum axis, and spring means biasing said motor means to pivot about said mounting axis in the direction for said drive means to engage said drum housing means, said motor means being pivotal about said mounting axis in the direction opposite said direction to disengage said drive means and drum housing means for removal of said drum unit means from said frame means, flexible snake means in said drum housing means, said snake means being rotatable with said drum housing means and axially displaceable inwardly and outwardly thereof, and snake feeding means mounted on said frame means outwardly of said drum housing means for displacing said snake means axially relative to drum housing means, said snake feeding means including feed housing means having an opening therethrough coaxial with said drum axis and through which said snake means extends, first, second and third snake engaging roller means in said opening, means including corresponding cam means supporting each said first and second roller means in said feed housing means in a selected one of at least first and second different snake engaging positions each radially fixed relative to said drum axis for said feeding means to accommodate snake means having different diameters, and means for biasing said third roller means into pressure engagement with said snake means.

23. A sewer cleaning machine according to claim 22, wherein said drum housing means has an outer surface coaxial with said drum axis and said drive means includes endless belt means frictionally engaging said outer surface of said drum housing means, said spring means biasing said motor means in the direction to tension said belt means.

24. A sewer cleaning machine according to claim 23, wherein said means supporting each said first and second roller means includes corresponding radially extending chamber means in said feed housing means and corresponding body member means radially displaceable in said chamber means and having radially outer end surface means, each said cam means extending transversely across the corresponding chamber means and being supported for rotation about a cam axis, and each said cam means having cam surface means engaging said radially outer end surface means of the corresponding body members.

25. A sewer cleaning machine according to claim 24, wherein each said radially outer end surface means is planar, and said cam surface means of each said cam means includes at least two planar cam surfaces parallel to said cam axis and each spaced a different distance therefrom.

26. A sewer cleaning machine according to claim 1, and means to rotate said drum means including motor means having output shaft means rotatable about a shaft axis parallel to said drum axis and drive means driven by said output shaft means for frictionally engaging said drum housing means to rotate said drum housing means, said motor means being mounted on said frame means for pivotal displacement about a mounting axis parallel to and offset from said shaft axis and said drum axis, and first spring means biasing said motor means to pivot about said mounting axis in the direction for said drive means to engage said drum housing means, said motor means being pivotal about said mounting axis in the direction opposite said direction to disengage said drive means and drum housing means for removal of said drum unit means from said frame means, said frame means including wheel means and support means for engaging an underlying surface to support said machine in a first position, and stabilizing means mounted on said frame means for pivotal displacement between storage and use positions relative thereto, said stabilizing means in said storage position being spaced above said underlying surface and in said use position engaging said underlying surface and cooperating with said support means to support said machine in a second position in which said wheel means is spaced above said underlying surface.

27. A sewer cleaning machine according to claim 26, wherein said drum housing means has an outer surface coaxial with said drum axis and said drive means includes endless belt means frictionally engaging said outer surface of said drum housing means, said first spring means biasing said motor means in the direction to tension said belt means.

28. A sewer cleaning machine according to claim 26, wherein said wheel means has an axis and said stabilizing means includes arm means pivotal about an arm axis parallel to said wheel means axis, said arm means having end means spaced from said arm axis and engaging said underlying surface in said use position of said stabilizing means.

29. A sewer cleaning machine according to claim 28, and second spring means biasing said arm means toward said storage position of said stabilizing means.

30. A sewer cleaning machine according to claim 29, wherein said arm axis coincides with said wheel means axis.

31. A sewer cleaning machine according to claim 26, and flexible snake means in said drum means, said snake means being rotatable with said drum housing means and axially displaceable inwardly and outwardly thereof, snake feeding means mounted on said frame means outwardly of said drum housing means for displacing said snake means axially relative to said drum housing means, said snake feeding means including feed housing means having an opening therethrough coaxial with said drum axis and through which said snake means extends, first, second and third snake engaging roller means in said opening, means including corresponding cam means supporting each said first and second roller means in said feed housing means in a selected one of at least first and second different snake engaging positions each radially fixed relative to said drum axis for said snake feeding means to accommodate snake means having different diameters, and means for biasing said third roller means into pressure engagement with said snake means.

32. A sewer cleaning machine according to claim 31, wherein said means supporting each said first and second roller means includes corresponding radially extending chamber means in said feed housing means and corresponding body member means radially displaceable in said chamber means and having radially outer end surface means, each said corresponding cam means extending transversely across the corresponding chamber means and being supported for rotation about a cam axis, and each said cam means having cam surface means engaging said radially outer end surface means of the corresponding body member means.

33. A sewer cleaning machine according to claim 32, wherein each said radially outer end surface means is planar, and said cam surface means of each said cam means includes at least two planar cam surfaces parallel to said cam axis and each spaced a different distance therefrom.

34. A sewer cleaning machine according to claim 31, wherein said wheel means has an axis and said stabilizing means includes arm means pivotal about an arm axis parallel to said wheel means axis, said arm means having end means spaced from said arm axis and engaging said underlying surface in said use position of said stabilizing means.

35. A sewer cleaning machine according to claim 34, and second spring means biasing said arm means toward said storage position of said stabilizing means.

36. A sewer cleaning machine according to claim 35, wherein said arm axis coincides with said wheel means axis.

37. A sewer cleaning machine according to claim 31, wherein said means releasably securing said drum shaft to said mounting member means includes threaded fastener means coaxial with said drum axis and axially interconnecting said drum shaft and said mounting member means.

38. A sewer cleaning machine according to claim 37, wherein said drum shaft has an inner end including a recess extending axially thereinto and said mounting member means has an outer end received in said recess.

39. A sewer cleaning machine according to claim 38, wherein said drum housing means has an outer surface coaxial with said drum axis and said drive means includes endless belt means frictionally engaging said outer surface of said drum housing means, said first spring means biasing said motor means in the direction to tension said belt means, said wheel means having an axis and said stabilizing means including arm means pivotal about an arm axis parallel to said wheel means axis, said arm means having end means spaced from said arm axis and engaging said underlying surface in said use position of said stabilizing means, and said means supporting each said first and second roller means including corresponding radially extending chamber means in said feed housing means and corresponding body member means radially displaceable in said chamber means and having radially outer end surface means, each said cam means extending transversely across the corresponding chamber means and being supported for rotation about a cam axis, and each said cam means having cam surface means engaging said radially outer end surface means of the corresponding body member means.

40. A sewer cleaning machine according to claim 1, and flexible snake means in said drum housing means, said snake means being rotatable with said drum housing means and axially displaceable inwardly and outwardly thereof, snake feeding means mounted on said frame means outwardly of said drum housing means for displacing said snake means axially relative to said drum housing means, said snake feeding means including feed housing means having an opening therethrough coaxial with said drum axis and through which said snake means extends, first, second and third snake engaging roller means in said opening, means including corresponding cam means supporting each said first and second roller means in said feed housing means in a selected one of at least first and second different snake engaging positions each radially fixed relative to said drum axis for said snake feeding means to accommodate snake means having different diameters, and means for biasing said third roller means into pressure engagement with said snake means, said frame means including wheel means and support means for engaging an underlying surface to support said machine in a first position, and stabilizing means mounted on said frame means for pivotal displacement between storage and use positions relative thereto, said stabilizing means in said storage position being spaced above said underlying surface and in said use position engaging said underlying surface and cooperating with said support means to support said machine in a second position in which said wheel means is spaced above said underlying surface.

41. A sewer cleaning machine according to claim 40, wherein said means supporting each said first and second roller means includes corresponding radially extending chamber means in said feed housing means and corresponding body member means radially displaceable in said chamber means and having radially outer end surface means, each said cam means extending transversely across the corresponding chamber means and being supported for rotation about a cam axis, and each said cam means having cam surface means engaging said radially outer end surface means of the corresponding body member means.

42. A sewer cleaning machine according to claim 41, wherein each said radially outer end surface means is planar, and said cam surface means of each said cam means includes at least two planar cam surfaces parallel to said cam axis and each spaced a different distance therefrom.

43. A sewer cleaning machine according to claim 40, wherein said wheel means has an axis and said stabilizing means includes arm means pivotal about an arm axis parallel to said wheel means axis, said arm means having end means spaced from said arm axis and engaging said underlying surface in said use position of said third support means.

44. A sewer cleaning machine according to claim 43, and spring means biasing said arm means toward said storage position of said third support means.

45. A sewer cleaning machine according to claim 44, wherein said arm axis coincides with said wheel means axis.

46. A sewer cleaning machine comprising frame means, drum means mounted on said frame means for rotation about a drum axis, said drum means having an axially outer end flexible snake means in said drum means, said snake means being rotatable with said drum means and axially displaceable inwardly and outwardly thereof relative to said outer end, means to rotate said drum means, said frame means including support means and wheel means for engaging an underlying surface to support said machine in a first position, and stabilizing means supported on said frame means for pivotal displacement between storage and use positions, said stabilizing means in said storage position being spaced above said underlying surface, and said stabilizing means in said use position engaging said underlying surface and cooperating with said support means to support said machine in a second position in which said wheel means is spaced above said underlying surface.

47. A sewer cleaning machine according to claim 46, and means biasing said stabilizing means toward said storage position.

48. A sewer cleaning machine according to claim 46, wherein said wheel means has a wheel axis and said stabilizing means is pivotal about an axis parallel to said wheel axis.

49. A sewer cleaning machine according to claim 48, wherein said axis for said stabilizing means coincides with said wheel axis.

50. A sewer cleaning machine according to claim 49, and means biasing said stabilizing means toward said storage position.

51. A sewer cleaning machine according to claim 48, wherein said axis parallel to said wheel axis is an arm axis and said stabilizing means includes arm means having a first end pivotally connected to said frame means at said arm axis, said arm means extending radially from said arm axis and having a second end spaced from said first end and including foot means extending parallel to said arm axis and engaging said underlying surface in said use position of said stabilizing means, and means for holding said stabilizing means in said storage position.

52. A sewer cleaning machine according to claim 46, wherein said frame means has laterally opposite sides and includes axle means extending in the direction between said opposite sides and providing said wheel axis, said wheel means including a wheel member on said axle means at each of said opposite sides, said stabilizing means including a pair of arm members each having an inner end pivotally mounted on said axle means adjacent a different one of said wheel members, each said arm member extending radially of said axle means and having an outer end beyond the corresponding wheel member, said outer end engaging said underlying surface when said stabilizing means is in said use position.

53. A sewer cleaning machine according to claim 52, wherein said inner ends of said arm members are axially between said frame means and the corresponding wheel member and said outer end of each said member includes foot means extending axially outwardly relative to the corresponding wheel member.

54. A sewer cleaning machine according to claim 53, and spring means biasing each said arm member toward said storage position.

55. A sewer cleaning machine according to claim 54, wherein said arm members and said frame means include means interengaging to stop arm members in said storage and use positions.

56. A sewer cleaning machine according to claim 12, wherein said frame means has front and rear ends and opposite sides, said support means being adjacent said front end, said wheel means being adjacent said rear end, said axis of said wheel means extending in the direction between said opposite sides, and said end means of said arm means in said use position engaging said underlying surface rearwardly of said wheel means axis with respect to the direction from said front end toward said rear end of said frame means.

57. A sewer cleaning machine according to claim 56, wherein said arm means axis coincides with said wheel means axis, and spring means biasing said arm means toward said storage position of said stablizing means.

58. A sewer cleaning machine according to claim 18, and spring means biasing the body member means of said first and second roller means radially outwardly of the corresponding chamber means.

59. A sewer cleaning machine according to claim 20, and spring biasing the body member means of said first and second roller means radially outwardly of the corresponding chamber means.

60. A sewer cleaning machine according to claim 59, wherein said spring means includes means engaging said pin means extending from said body member means of said first and second roller means.

61. A sewer cleaning machine according to claim 60, wherein said spring means further includes means engaging said pin means extending from said body member means of said third roller means, said first, second and third roller means having a neutral position relative to said snake means, and said spring means biases said pin means extending from body member means of said first, second and third roller means to urge said roller means toward said neutral positions thereof.

62. A sewer cleaning machine according to claim 24, and spring means biasing the body member means of said first and second roller means radially outwardly of the corresponding chamber means.

63. A sewer cleaning machine according to claim 28, wherein said frame means has front and rear ends and opposite sides, said support means being adjacent said front end, said wheel means being adjacent said rear end, said axis of said wheel means extending in the direction between said opposite sides, and said end means of said arm means in said use position engaging said underlying surface rearwardly of said wheel means axis with respect to the direction from said front end toward said rear end of said frame means.

64. A sewer cleaning machine according to claim 63, wherein said arm means axis coincides with said wheel means axis, and second spring means biasing said arm means toward said storage position of said stablizing means.

65. A sewer cleaning machine according to claim 32, and spring biasing the body member means of said first and second roller means radially outwardly of the corresponding chamber means.

66. A sewer cleaning machine according to claim 34, wherein said frame means has front and rear ends and opposite sides, said support means being adjacent said front end, said wheel means being adjacent said rear end, said axis of said wheel means extending in the direction between said opposite sides, and said end means of said arm means in said use position engaging said underlying surface rearwardly of said wheel means axis with respect to the direction from said front end toward said rear end of said frame means.

67. A sewer cleaning machine according to claim 66, wherein said arm means axis coincides with said wheel means axis, and second spring means biasing said arm means toward said storage position of said stablizing means.

68. A sewer cleaning machine according to claim 39, wherein said frame means has front and rear ends and opposite sides, said support means being adjacent said front end, said wheel means being adjacent said rear end, said axis of said wheel means extending in the direction between said opposite sides, said arm means axis coinciding with said wheel means axis, said means of said arm means in said use position engaging said underlying surface rearwardly of said wheel means axis with respect to the direction from said front end toward said rear end of said frame means, second spring means biasing said arm means toward said storage position of said stablizing means, and third spring means biasing the body member means of said first and second roller means radially outwardly of the corresponding chamber means.

69. A sewer cleaning machine according to claim 41, and spring means biasing the body member means of said first and second roller means radially outwardly of the corresponding chamber means.

70. A sewer cleaning machine according to claim 43, wherein said frame means has front and rear ends and opposite sides, said support means being adjacent said front end, said wheel means being adjacent said rear end, said axis of said wheel means extending in the direction between said opposite sides, said arm means axis coinciding with said wheel means axis, said end means of said arm means in said use position engaging said underlying surface rearwardly of said wheel means axis with respect to the direction from said front end toward said rear end of said frame means, and spring means biasing said arm means toward said storage position of said stablizing means.

71. A sewer cleaning machine according to claim 51, wherein said frame means has front and rear ends and opposite sides, said support means being adjacent said front end, said wheel means being adjacent said rear end, said axis of said wheel means extending in the direction between said opposite sides, and said foot means of said arm means in said use position engaging said underlying surface rearwardly of said wheel means axis with respect to the direction from said front end toward said rear end of said frame means.

72. A sewer cleaning machine according to claim 71, wherein said arm means axis coincides with said wheel means axis, and spring means biasing said arm means toward said storage position and providing said means for holding said stablizing means in said storage position.

73. A sewer cleaning machine according to claim 52, wherein said frame means has front and rear ends, said support means being adjacent said front end, said wheel means being adjacent said rear end, and said outer end of each said arm member in said use position engaging said underlying surface rearwardly of said axle means with respect to the direction from said front end toward said rear end of said frame means.

74. A sewer cleaning machine according to claim 73, and spring means biasing each said arm member toward said storage position.

75. A sewer cleaning machine according to claim 55, wherein said frame means has front and rear ends, said support means being adjacent said front end, said wheel means being adjacent said rear end, and said foot means of each said arm member in said use position engaging said underlying surface rearwardly of said axle means with respect to the direction from said front end toward said rear end of said frame means.

* * * * *

UNITED STATES PATENT AND TRADEMARK OFFICE

CERTIFICATE OF CORRECTION

PATENT NO. : 5,031,276

DATED : July 16, 1991

INVENTOR(S) : Larry F. Babb et al

It is certified that error appears in the above-identified patent and that said Letters Patent is hereby corrected as shown below:

Column 13, line 24, change "removably" to --- removable ---. Column 19, line 30, after "end" insert --- , ---.

Signed and Sealed this

Twenty-second Day of March, 1994

*Attest:*

Bruce Lehman

BRUCE LEHMAN

*Attesting Officer*

*Commissioner of Patents and Trademarks*